US005992560A

United States Patent [19]

Matsuoka et al.

[11] Patent Number: 5,992,560

[45] Date of Patent: Nov. 30, 1999

[54] MUFFLER FOR INTERNAL COMBUSTION ENGINE

[75] Inventors: Hirotake Matsuoka; Keiichi Sakashita; Keiji Yamada; Yoshio Nishikawa; Koji Fukushima, all of Ohgaki, Japan

[73] Assignee: Ibiden Co., Ltd., Ohgaki, Japan

[21] Appl. No.: 08/945,177

[22] PCT Filed: Sep. 20, 1996

[86] PCT No.: PCT/JP96/02732

§ 371 Date: Oct. 20, 1997

§ 102(e) Date: Oct. 20, 1997

[87] PCT Pub. No.: WO97/31181

PCT Pub. Date: Aug. 28, 1997

[30] Foreign Application Priority Data

Feb. 21, 1996 [JP] Japan ..... 8-34131

[51] Int. Cl.[6] ..... F01N 1/10

[52] U.S. Cl. ..... 181/252; 181/256; 181/282

[58] Field of Search ..... 181/227, 228, 181/252, 256, 258, 282

[56] References Cited

U.S. PATENT DOCUMENTS

| | | | |
|---|---|---|---|
| 3,955,643 | 5/1976 | Clark | 181/256 |
| 4,140,426 | 2/1979 | Gonzalez et al. | 181/227 |
| 5,371,331 | 12/1994 | Wall | 181/227 |
| 5,633,482 | 5/1997 | Erion et al. | 181/282 |
| 5,670,756 | 9/1997 | Ohtaka et al. | 181/256 |

FOREIGN PATENT DOCUMENTS

| | | |
|---|---|---|
| 61-59819 U | 4/1986 | Japan . |
| 61-166114 U | 10/1986 | Japan . |
| 2-126014 U | 10/1990 | Japan . |
| 3-32611 U | 3/1991 | Japan . |
| 4-71234 U | 6/1992 | Japan . |
| 4-127824 U | 11/1992 | Japan . |
| 5-66210 U | 9/1993 | Japan . |
| 6-19785 | 5/1994 | Japan . |

*Primary Examiner*—Khanh Dang
*Attorney, Agent, or Firm*—Oliff & Berridge, PLC

[57] ABSTRACT

The invention provides a muffler for an internal combustion engine having excellent durability (resistance to scattering) even when being exposed to a high-temperature exhaust gas and capable of maintaining a high sound absorption coefficient over a long period. Such a muffler comprises a metal tube provided with a plurality of small holes, an inorganic fiber sound-absorbing material arranged on the outer periphery thereof and a metal shell covering the outside of the sound-absorbing material, in which a scattering prevention member is disposed between the metal tube and the sound-absorbing material. The sound-absorbing material is a laminated structure of crystalline alumna fiber mat and glass fiber mat. As the scattering prevention member, there is used a stainless woven wire cloth, a woven fabric made from inorganic fiber and a metal roll.

6 Claims, 4 Drawing Sheets

MUFFLER FOR INTERNAL COMBUSTION ENGINE

TECHNICAL FIELD

This invention relates to a muffler for internal combustion engine, and more particularly to a muffler disposed in a halfway of an exhaust tube for an automobile engine so as to damp noise component included in an exhaust gas discharged from the engine.

BACKGROUND ART

A sound-damping treatment for noise component included in an exhaust gas is carried out by disposing a muffler in a halfway of an exhaust tube.

As the muffler, there are known various structures, among which an adequate structure is used in accordance with conditions such as a displacement of an engine and the like. As the muffler for damping noise component of high frequency among various noise components included in the exhaust gas, there is well-known a structure that an inorganic fiber sound absorbing material is disposed around a metal tube (inner tube) provided with a plurality of small holes and then covered with a metal shell.

In such a muffler, glass fibers having a low heat resistance and the like are usually used as the inorganic fiber sound absorbing material. Recently, the rise of exhaust gas temperature becomes conspicuous with the advancement of engine performances, and hence the glass fibers are fused and shrunk by heat of the exhaust gas to form beads. On the other hand, pressure shock accompanied with the passage of the high-temperature exhaust gas concentrates in the small holes of the metal tube and hence the metal tube vibrates or the passing exhaust gas pulsates. Thus, the bead-shaped glass fiber is put through the small holes into the inside of the metal tube and scattered to the outside together with the exhaust gas. Therefore, this muffler has a problem that the sound damping effect is considerably degraded.

In order to solve the above problem, a muffler 1 as shown in FIG. 1 has been proposed in JP-U-61-59819 and JP-Y-6-19785. In the muffler 1, a metal cushioning material 6 such as stainless wool is interposed between a metal tube 3 provided with a plurality of small holes 2 and a sound absorbing material 5 covered with a metal shell 4 and made from glass fibers.

Since the muffler 1 is to damp noise components, however, the metal cushioning material 6 is rendered into an interconnecting cell structure and does not thermally protect the glass fiber sound absorbing material 5. Further, the metal cushioning material is softened by heat of the exhaust gas, so that the effect as a cushioning material is very low. As a result, the conventional muffler 1 has a drawback that it is difficult to damp noise components over a long period.

And also, there is disclosed a method of improving the heat resistance by using silica-alumina ceramic fiber or general-purpose crystalline alumina fiber as the inorganic fiber sound absorbing material. However, the silica-alumina ceramic fiber contains about 50 wt % of granulated substance called as shot, so that there is caused a problem that the shot is moved inside the sound absorbing material by vibration to form spaces in the sound absorbing material. On the other hand, the general-purpose crystalline alumina fiber is a refractory heat-insulating material usually used as a thermal insulant for a high-temperature ceramic furnace of about 1400° C. and has an average fiber size of 2.7–3.2 $\mu$m, which is finer than an average fiber size of the conventional glass fiber of about 9 $\mu$m, and a high true specific gravity. For this end, the pressure drop becomes higher and particularly there is caused a problem that sound absorption coefficient at a high frequency side is considerably low.

On the contrary, there is a method of increasing a filling density of the general-purpose crystalline alumina fiber. However, as the filling density increases, mass as a sound absorbing layer becomes higher and noise hardly enters into the sound absorbing layer and hence there is caused a problem that the sound absorption coefficient as a whole lowers.

In general, the muffler has a structure that both ends of the metal shell having a diameter larger than that of the metal tube are size-reduced to approximately an outer diameter of the metal tube and fixed to an outer periphery of the metal tube at each opening portion of the metal shell through welding and the sound absorbing material is filled in a space defined between the metal tube and the metal shell. In such a structure, the metal tube is compressed to cause buckling due to the difference in thermal expansion between the metal tube exposed to the high-temperature exhaust gas and the metal shell exposed to air, or the weld portion between the metal tube and the metal shell is peeled off to cause the leakage of the exhaust gas and hence there is a problem that sound radiating the exhaust gas becomes large.

In order to solve the above problems, there is known a structure that the welding between the metal tube and the metal shell is carried out at either an opening portion at both ends of the metal shell, while a mesh-shaped stainless gasket is previously attached to the other opening portion of the metal shell and interposed between the metal tube and the metal shell, whereby the influence of the thermal expansion difference between the metal tube and the metal shell is eliminated to prevent the leakage of the exhaust gas to thereby control volume of radiating sound. However, the gasket should be previously fixed to the metal shell by spot welding or the like, so that the number of assembling steps increases and also the cost increases.

DISCLOSURE OF THE INVENTION

It is an object of the invention to solve the aforementioned problems and to provide a muffler for internal combustion engine having an excellent durability (resistance to scattering) even when being exposed to the high-temperature exhaust gas, and maintaining the air tightness in the joint portion between the metal tube and the metal shell without being influenced by the thermal expansion difference therebetween and capable of maintaining the high sound absorption coefficient over a long period.

The invention lies in a muffler for internal combustion engine comprising a metal tube provided with a plurality of small holes, an inorganic fiber sound absorbing material arranged on an outer periphery thereof and a metal shell covering an outside of the sound absorbing material, characterized in that a scattering prevention member is disposed between the metal tube and the sound absorbing material, and the sound absorbing material has a lamination structure that a crystalline alumina fiber mat containing not more than 10 wt % of granulated substance of not less than 44 $\mu$m and having an average fiber size of 3.5–10 $\mu$m is arranged on an outer periphery of the scattering prevention member at a filling density of 0.05–0.30 g/cm$^3$ and a glass fiber mat is laminated on an outer periphery of the crystalline alumina fiber mat at a filling density of 0.10–0.30 g/cm$^3$.

In a preferable embodiment of the invention, the scattering prevention member is selected from a stainless woven wire cloth, a woven fabric made from inorganic fiber and a metal foil.

In the muffler according to the invention, the scattering prevention member is arranged between the metal tube and the sound absorbing material instead of the stainless wool used in the conventional muffler, so that the sound absorbing material can be protected from pressure shock concentrating in the small holes of the metal tube accompanied with the passage of the high-temperature exhaust gas and also noise components passed through the small holes can effectively be absorbed by the sound absorbing material.

Since the crystalline alumina fiber mat having excellent heat resistance and heat insulating property is wound around the metal tube as a sound absorbing material, heat conduction to the glass fiber mat laminated on the outer peripheral portion thereof is controlled and hence the degradation of the glass fiber due to heat of the exhaust gas is prevented and the scattering of the fiber due to vibration and pulsation of the exhaust gas is not caused. Furthermore, the crystalline alumina fiber mat is superior in the sound absorptivity to the stainless wool, so that the muffler can be compacted.

BEST MODE FOR CARRYING OUT THE INVENTION

The invention will be described in detail with reference to FIG. 2, FIG. 3, FIG. 4 and FIG. 5 below. In these figures, the same member is represented by the same numeral.

Figure 2:
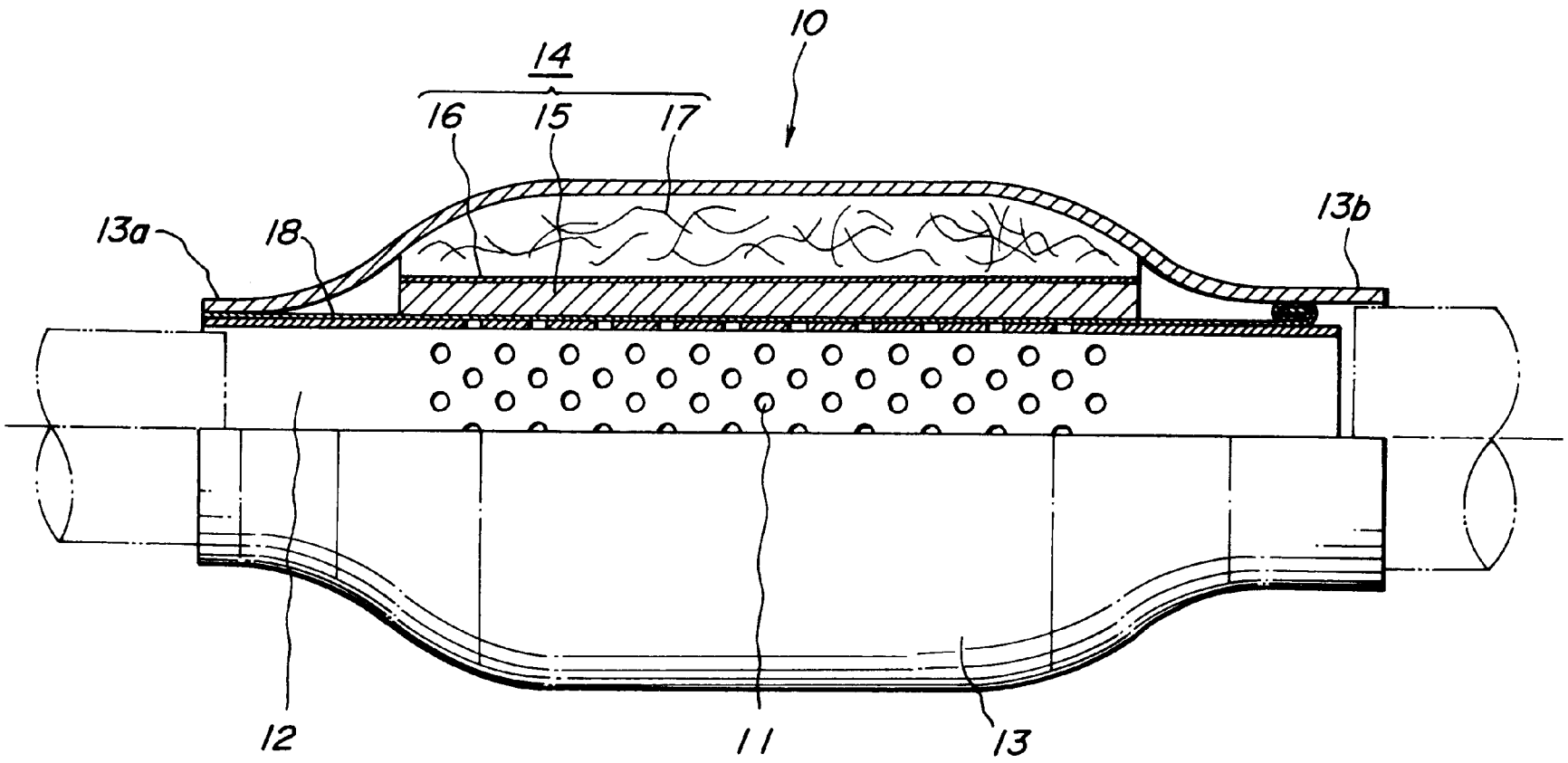
FIG. 2 is a plane view partly shown in section of an embodiment of the muffler according to the invention.

A first embodiment of the muffler according to the invention is shown in FIG. 2. This muffler 10 comprises a metal tube 12 provided with a plurality of small holes 11, a metal shell 13, a sound absorbing material 14 filled in a space between the metal tube 12 and the metal shell 13 and having a lamination structure of a crystalline alumina fiber mat 15, a stainless woven wire cloth 16 and a glass fiber mat 17, in which a stainless woven wire cloth 18 is disposed between the metal tube and the sound absorbing material as a scattering prevention member for the sound absorbing material.

The metal shell 13 is not particularly restricted to the illustrated shape as far as a space filling the sound absorbing material 14 is defined between the metal shell and the metal tube 12, but it is necessary that a size of opening portions 13*a* and 13*b* at both ends of the metal shell 13 is made slightly larger than an outer diameter of the metal tube 12. Further, it is important that either the opening portion 13*a* or 13*b*, e.g. the opening portion 13*a* in the illustrated embodiment is fixed to the metal tube 12, for example, by welding and the remaining opening portion 13*b* is not fixed thereto.

The stainless woven wire cloth 18 as the scattering prevention member arranged on the outer periphery of the metal tube 12 between the metal tube 12 and the sound absorbing material 14 is fixed at its one end to either the metal tube 12 or the metal shell 13 or both in the opening portion 13*a*. Further, the other end of the stainless woven wire cloth 18 is folded by at least one turn to render into a thickness corresponding to a gap between the opening portion 13*b* of the metal shell 13 and the metal tube 12 and air tightness of the opening portion 13*b* is attained by inserting the folded portion formed in the other end into the gap between the opening portion 13*b* of the metal shell 13 and the metal tube 12.

The muffler 10 having the above structure protects the sound absorbing material 14 from pressure shock concentrating in the small holes 11 of the metal tube 12 accompanied with the passage of the high-temperature exhaust gas because the stainless woven wire cloth 18 as the scattering prevention member is disposed between the metal tube 12 and the sound absorbing material 14. On the other hand, the stainless woven wire cloth 18 passes noise component from the small hole 11 to the sound absorbing material 14, so that the noise component is surely absorbed by the sound absorbing material 14.

Furthermore, an end of the stainless woven wire cloth 18 is fixed in either opening portion 13*a* or 13*b* to either the metal tube 12 or the metal shell 13 or both by welding, while the other end thereof is folded one or more times and inserted into the gap between the remaining opening portion of the metal shell 13 and the metal tube 12 without fixation, so that there can be realized a structure of mitigating the influence of thermal expansion difference produced between the inside of the metal tube passing the high-temperature exhaust gas and the outside of the metal shell contacting with air. As a result, the aforementioned problems such as buckling due to compression of the metal tube, peeling at the weld portion between the metal tube and the metal shell and the like are avoided.

Since the folded portion in the end of the stainless woven wire cloth 18 is interposed between the opening portion 13*b* of the metal shell 13 and the metal tube 12 as the scattering prevention member, not only the leakage of the exhaust gas is prevented, but also the reduction of the number of assembling steps for the muffler can be realized. That is, the step of attaching the mesh-shaped stainless gasket to the metal shell can be omitted and the number of the parts can be decreased and hence the muffler can be assembled more cheaply.

The stainless woven wire cloth as the scattering prevention member is favorable to be made from SUS304, stainless SUS430 or the like from a viewpoint of the heat resistance and flexibility. Particularly, it is advantageous to use a stainless woven wire cloth having a wire diameter of 0.1–1 mm and a net of 5–100 mesh. When the wire diameter is less than 0.1 mm, the flexibility is excellent but the wire cloth is prematurely fused by the exhaust gas recently being at a considerably higher temperature state to degrade the durability. While, when the wire diameter exceeds 1 mm, the durability is excellent but the flexibility becomes poor to degrade the processability. Therefore, the wire diameter is advantageous within a range of 0.1–1 mm, more particularly 0.12–0.20 mm.

Further, when the net is coarser than 5 mesh, the sound absorbing material is dropped off from the net due to vibration of the vehicle, the stream of the exhaust gas and the like and scattered into air through the small holes, while when it is finer than 100 mesh, the noise component included in the exhaust gas is reflected to decrease the sound damping effect. Therefore, the net is advantageous within a range of 5–100 mesh, more particularly 50–80 mesh.

Figure 3:
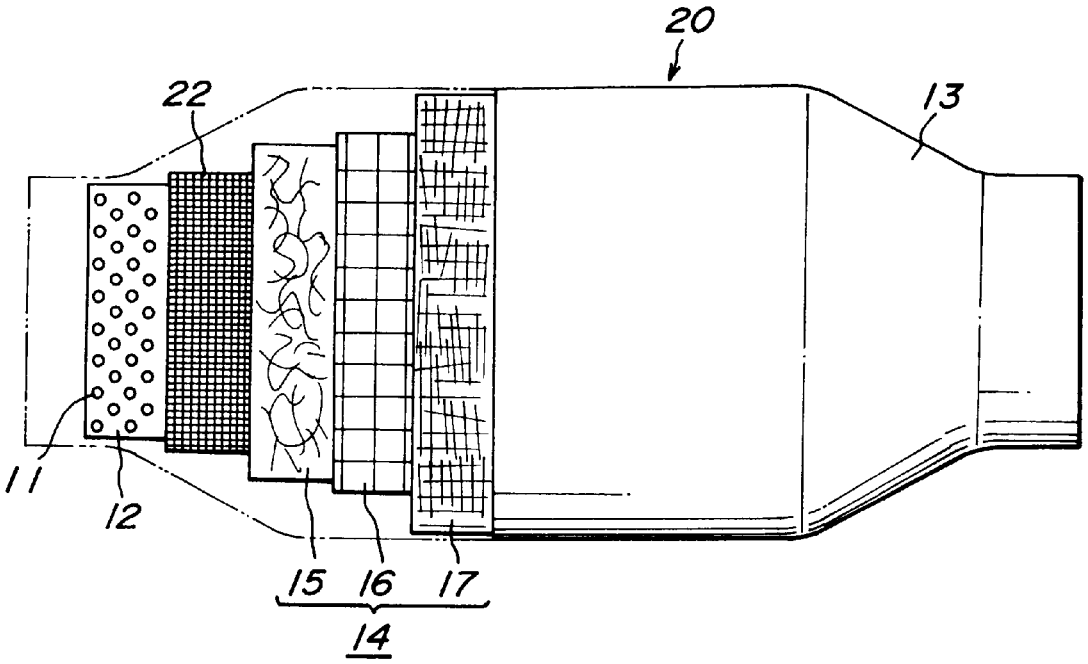
FIGS. 3 and 4 are partly developed plan views of the other embodiments of the muffler according to the invention, respectively.

A second embodiment of the muffler according to the invention is shown in FIG. 3. This muffler 20 has the same structure as the muffler 10 of FIG. 2 except that woven fabric 22 made from inorganic fibers is used as the scattering prevention member.

The woven fabric 22 is required to have excellent heat resistance, corrosion resistance and flexibility, so that there is used a woven fabric of inorganic fiber having a high heat resistance and selected from ceramic fiber, alumina fiber, silica fiber and so on.

In the inorganic fiber woven fabric, a thickness is 0.5–2 mm, a filament diameter is 3–100 $\mu$m, and the number of each of wefts and warps per 25 $mm^2$ is 5–50. When the thickness is less than 0.5 mm, the durability is poor, while when it exceeds 2 mm, the noise component included in the exhaust gas is reflected to decrease the sound damping effect. When the filament diameter is less than 3 $\mu$m, the flexibility is excellent but the durability is insufficient, while when it exceeds 100 $\mu$m, the durability is excellent but the flexibility is poor and the processability is degraded. Preferably, the filament diameter is within a range of 5–15 $\mu$m. When the number of each of the wefts and warps per 25 $mm^2$ is less than 5, the sound absorbing material is dropped off from the nets of the woven fabric due to vibrations of the vehicle, the exhaust gas stream or the like and scattered into air through the small holes, while the number per 25 $mm^2$ exceeds 50, the noise component included in the exhaust gas is reflected to decrease the sound damping effect. Preferably, the number of each of the wefts and warps per 25 $mm^2$ is within a range of 9–30.

Figure 4:
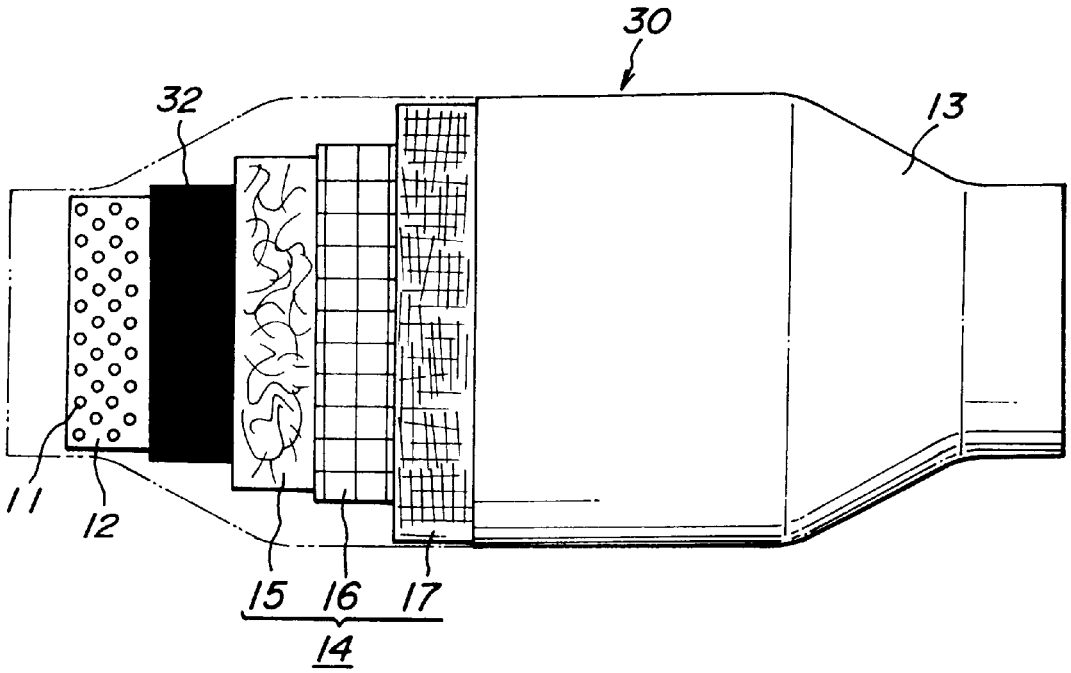

A third embodiment of the muffler according to the invention is shown in FIG. 4. This muffler 30 has the same structure as the muffler 10 of FIG. 2 except that a metal foil 32 is used as the scattering prevention member.

The metal foil 32 is favorable to have a surface density of 0.05–0.27 $kg/m^2$. In general, when the densified body is arranged on the surface of the sound absorbing material, sound energy to be absorbed by the sound absorbing material is not inserted by a sound insulating action based on a law of mass and hence the sound absorption coefficient is degraded. However, when the surface density of the metal foil is within the above range, it has newly been found out that the sound damping effect is considerably developed at a sound zone of 100–5000 Hz required in the muffler for automobile. Preferably, the surface density of the metal foil is within a range of 0.07–0.16 $kg/m^2$.

As the metal foil, use may be made of a composite material formed by depositing or plating a metal onto a paper of inorganic fiber.

The crystalline alumina fiber mat constituting a part of the sound absorbing material used in the muffler according to the invention and arranged on the outer periphery of the scattering prevention member will be described below. The crystalline alumina fiber constituting the mat is different from the general-purpose crystalline alumina fiber used in the conventional muffler and is alumina fiber having an alumina content of 72–85%, a silica content of 15–28%, an average fiber size of 3.5–10 $\mu$m, preferably 4.5–6.5 $\mu$m and containing not more than 10 wt % of granulated substance of not less than 44 $\mu$m.

In such a crystalline alumina fiber, when the alumina content is higher than 85%, the true specific gravity of the fiber is high and the porosity is large, so that the pressure drop is low and the sound absorptivity lowers. Further, when the silica content is higher than 28%, silica crystal is liable to be existent and the strength of the fiber lowers. And also, when the average fiber size is less than 3.5 $\mu$m, the pressure drop becomes higher and the sound absorption coefficient at a high frequency side lowers. While, when the average fiber size exceeds 10 $\mu$m, the pressure drop becomes lower and the sound absorption coefficient at a low frequency side lowers. Moreover, when the content of granulated substance of not less than 44 $\mu$m is more than 10 wt %, the granulated substance or shot is moved in the crystalline alumina fiber mat by vibrations to form spaces in the mat likewise the aforementioned silica-alumina ceramic fiber.

The crystalline alumina fiber mat used in the invention is a mat formed by filling the crystalline alumina fiber at a filling density of 0.05–0.30 $g/cm^3$, preferably 0.20–0.25 $g/cm^3$. When the filling density is less than 0.05 $g/cm^3$, there is a problem in the durability of the mat, while when the filling density exceeds 0.30 $g/cm^3$, the sound damping effect is degraded and also the insertion into the metal shell is considerably difficult.

As the glass fiber mat constituting a part of the sound absorbing material according to the invention and covering the outer periphery of the crystalline alumina fiber mat, there is used a mat having a filling density of 0.10–0.30 $g/cm^3$.

When the filling density of the glass fiber is less than 0.10 $g/cm^3$, there is caused a problem in the durability, while when the filling density exceeds 0.30 $g/cm^3$, the sound damping effect is degraded and also the insertion into the metal shell is difficult.

In the sound absorbing material 14 having a lamination structure of the crystalline alumina fiber mat and the glass fiber mat as shown in FIGS. 2–4, a stainless woven wire cloth 16 is wound on the outer periphery of the crystalline alumina fiber mat 15 for adjusting the filling density of each mat to a given value.

The glass fiber mat is usually formed by needling, so that the elastic force of the fiber is controlled. On the other hand, the crystalline alumina fiber mat increases the repulsive force as the filling density becomes high. Therefore, even if the filling density is set to crystalline alumina fiber mat: 0.20 $g/cm^3$ and glass fiber mat: 0.30 $g/cm^3$, when the laminate of these mats is actually mounted in the muffler without the stainless woven wire cloth, the glass fiber mat is crushed by the crystalline alumina fiber mat, whereby the filling density is changed into crystalline alumina fiber mat: 0.18 g/cm and glass fiber mat: 0.32 $g/cm^3$, respectively, and hence the resulting muffler may not be used because the filling density is outside the given range.

Therefore, it is preferable to wind the stainless woven wire cloth on the outer periphery of the crystalline alumina fiber mat. The stainless woven wire cloth is required to select ones having a heat resistance and being not deformed by elastic force of the crystalline alumina fiber mat.

Such a stainless woven wire cloth is made from SUS304, SUS430 or the like and is favorable to have a wire diameter of 0.1–1 mm and a net of 5–50 mesh.

Moreover, the filling thickness of the crystalline alumina fiber mat and glass fiber mat is determined by setting the filling thickness of the crystalline alumina fiber mat. That is, the heat-resistant temperature of the glass fiber is usually 600–800° C., so that it is necessary to set the filling thickness of the crystalline alumina fiber mat so as to render a temperature applied to the glass fiber mat into not higher than 600° C.

A method of assembling the crystalline alumina fiber mat and the glass fiber mat will be described below.

In the assembling of these mats, there are, for example, the following two methods. A first method is a method of using the crystalline alumina fiber mat and the glass fiber mat each packed with a plastic film under vacuum. In the first method, each vacuum-packed mat is successively wound around the metal tube and then assembled into the inside of the metal shell. A second method is a method of using a sub-assembled product formed by winding the stainless woven wire cloth 18 as a scattering prevention member and a laminate of crystalline alumina fiber mat 15, stainless woven wire cloth 16 and glass fiber mat 17 as a sound absorbing material 14 around the metal tube 12 and placing in a bag 34 of a plastic film. In the second method, the sub-assembled product is inserted into the metal shell 13 up to a given position while deaerating the inside of the bag 34 through a hose 36.

In the conventional muffler, the surface of the glass fiber mat is subjected to a curing treatment with an inorganic binder for facilitating the shape-holding and assembling of the mat. In this case, however, the elasticity of the glass fiber mat is damaged to lower the sound absorption coefficient. According to the invention, the assembling of the glass fiber mat is carried out by the aforementioned method without surface curing.

As the plastic film, there are plastic films made from silicone resin, polyvinyl chloride, polyethylene, ionomer resin and the like. Particularly, it is desirable that the surface of the plastic film has a good lubricity in order to facilitate the insertion into the inside of the metal shell. That is, the plastic film is desirable to be made from a material having a low surface friction coefficient, so that the polyvinyl chloride, polyethylene and ionomer resin are particularly favorable.

In any methods, the sub-assembling product of metal tube, scattering prevention member, sound absorbing material and the like is inserted into the metal shell and placed on a given position. Thereafter, in order to connect both end portions of the metal shell to front and rear exhaust tubes, the opening diameter at both ends of the metal shell is reduced to a given size, or a cone for the connection to the exhaust tube is welded to each end of the metal shell.

EXAMPLE 1

A muffler according to the invention will be described with reference to FIGS. 2 and 5.

According to the structure shown in FIG. 2, a metal tube of SUS409 having a thickness of 1.2 mm (outer diameter: 63.5 mm) provided with a plurality of small holes 11 having a diameter of 2 mm at an opening ratio of 35% is used as a metal tube 12, and a pipe of SUS409 having a thickness of 1.5 mm (outer diameter: 112.5 mm) is used as a metal shell 13, and a stainless woven wire cloth 18 of SUS304 having a wire diameter of 0.12 mm and a net of 80 mesh is used as a scattering prevention member covering the metal tube 12.

Figure 5:
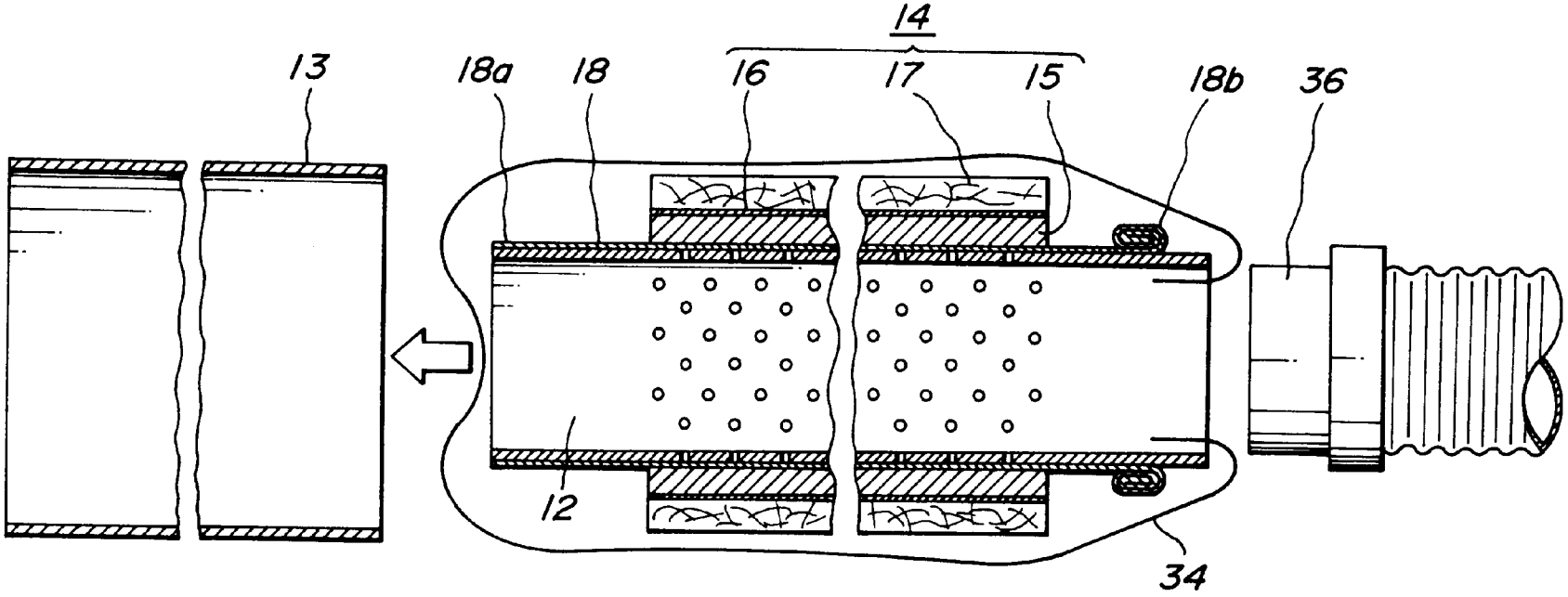
FIG. 5 is a diagrammatic view illustrating an assembling method of the muffler shown in FIG. 2.

As shown in FIG. 5, a sub-assembling product comprising a metal tube 12, a stainless woven wire cloth 18 as a scattering prevention member and a laminate of a glass fiber mat 17, a stainless woven wire cloth 16 and a crystalline alumina fiber mat 15 as a sound absorbing material 14 is prepared as follows.

At first, an end 18*a* of the stainless woven wire cloth 18 as the scattering prevention member is fixed to the metal tube 12 by welding, while the other end 18*b* is folded at a width of 10 mm two times. Then, the crystalline alumina fiber mat 15 having an alumina content of 80%, a silica content of 20%, an average fiber size of 4.3 $\mu$m, a filling density of 0.24 g/cm$^3$ and a thickness of 10 mm is wound on the outer periphery of the stainless woven wire cloth 18 at the side of the metal tube 12. In the crystalline alumina fiber mat 15, the content of granulated substance of not less than 44 $\mu$m is 5%. Next, the stainless woven wire cloth 16 (wire diameter: 0.1 mm, net: 30 mesh) is wound on the outer periphery of the crystalline alumina fiber mat 15. Further, the glass fiber mat 17 having an average fiber size of 9 $\mu$m, a filling density of 0.16 g/cm$^3$ and a thickness of 13 mm is wound on the outer periphery of the stainless woven wire cloth 16. These members are covered with a polyethylene plastic sheet 34 to form a sub-assembling product.

The sub-assembling product is inserted into the metal shell 13 up to a given position under pressure while deaerating the inside of the sheet 34 in the sub-assembling product through a hose 36. Finally, both end portions of the metal shell 13 are size-reduced to a given opening diameter for connecting to an exhaust tube to form a muffler 10 shown in FIG. 2.

Moreover, a folded portion (18*b*) of the stainless woven wire cloth 18 as the scattering prevention member airtightly inserted in a gap between the metal shell 13 and the metal tube 12 at an opening portion 13*b* of the metal shell 13 as shown in FIG. 2.

The muffler 10 is connected to an exhaust tube for a gasoline engine having a displacement of 2000 cc with 6-cylinders and then the engine is run at 4000 revolutions per minute, during which noise generated from the exhaust tube is measured to obtain result as shown in Table 1. The value shown in this table is a noise value measured at a position separated by 1 m behind the exhaust tube.

After the vehicle is actually run over 30000 km, noise from the exhaust tube and weight loss ratio of the sound absorbing material are measured to obtain results as shown in Table 1.

EXAMPLE 2

The same procedure as in Example 1 is repeated to prepare a muffler having a filling density of the crystalline alumina fiber mat of 0.05 g/cm$^3$ and a filling density of the glass fiber mat of 0.3 g/cm$^3$. The same measurement as in Example 1 is carried out with respect to this muffler. The results are shown in Table 1.

EXAMPLE 3

The same procedure as in Example 1 is repeated to prepare a muffler having a filling density of the crystalline alumina fiber mat of 0.30 g/cm$^3$ and a filling density of the glass fiber mat of 0.3 g/cm$^3$. The same measurement as in Example 1 is carried out with respect to this muffler. The results are shown in Table 1.

EXAMPLE 4

A muffler 20 having a structure shown in FIG. 3 is prepared by repeating the same procedure as in Example 1. In this case, a woven fabric 36 of alumina long fibers having a filament diameter of 10 $\mu$m and the number of each of wefts and warps of 15 per 25 mm$^2$ of woven fabric is used instead of the stainless woven wire cloth as the scattering prevention member. The same measurement as in Example 1 is carried out with respect to this muffler 20. The results are shown in Table 1.

EXAMPLE 5

A muffler 30 having a structure shown in FIG. 4 by repeating the same procedure as in Example 1. In this case, a metal foil 46 of SUS304 having a surface density of 0.16 kg/m$^2$ instead of the stainless woven wire cloth as the scattering prevention member. The same measurement as in Example 1 is carried out with respect to this muffler 30. The results are shown in Table 1.

COMPARATIVE EXAMPLE 1

A muffler is prepared by repeating the same procedure as in Example 1 without using the stainless woven wire cloth as the scattering prevention member, and the noise is measured in the same manner as in Example 1. The results are shown in Table 1.

COMPARATIVE EXAMPLE 2

Figure 1:
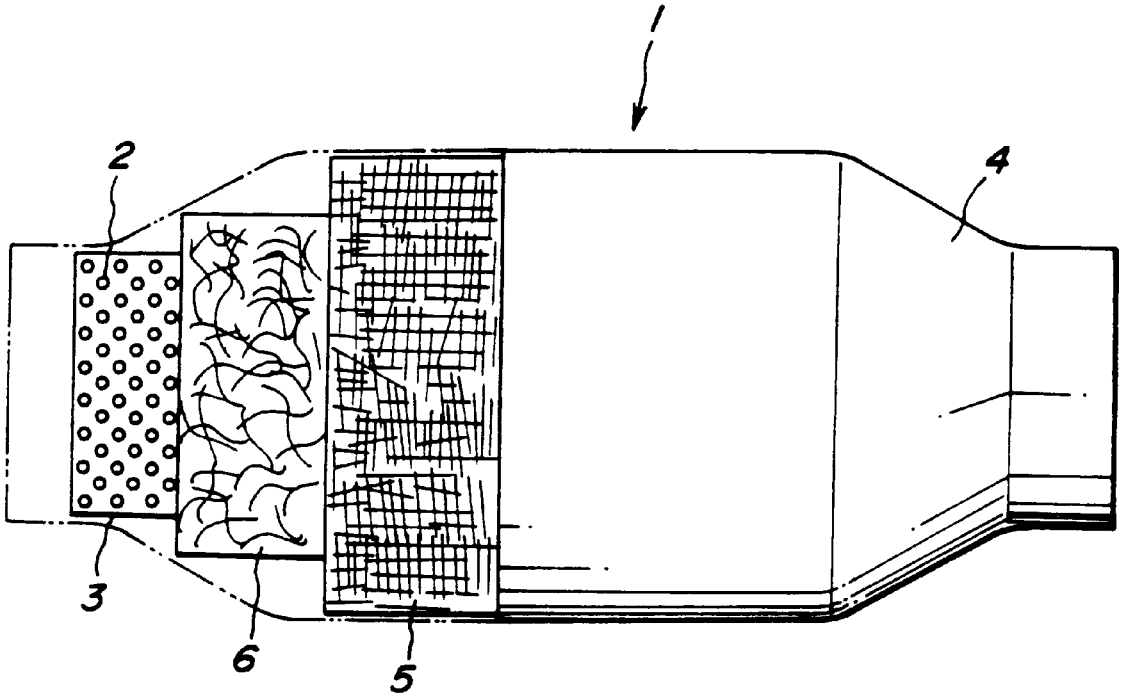
FIG. 1 (PRIOR ART)
FIG. 1 is a partly developed plan view of the conventional muffler.

A muffler 1 having a structure shown in FIG. 1 is prepared. In this case, the metal tube 2 and the metal shell 3 are the same as in Example 1. A glass fiber mat 5 having an average fiber size of 9 $\mu$m, a filling density of 0.16 g/cm$^3$ and a thickness of 18 mm is used as the sound absorbing material, and a stainless wool 6 (wire diameter: 70 $\mu$m, SUS430) is arranged in the side of the metal tube 2 at a filling density of 0.56 g/cm$^3$ and a thickness of 5 mm as a scattering prevention member for the sound absorbing material. The same measurement as in Example 1 is carried out with respect to this muffler 1. The results are shown in Table 1.

COMPARATIVE EXAMPLE 3

A muffler is prepared by repeating the same procedure as in Example 1 except that a crystalline alumina fiber mat having an average fiber size of 2.9 $\mu$m, a filling density of 0.24 g/cm$^3$ and a thickness of 10 mm is used. The same measurement as in Example 1 is carried out with respect to this muffler. The results are shown in Table 1.

COMPARATIVE EXAMPLE 4

A muffler is prepared by repeating the same procedure as in Example 1 except that a crystalline alumina fiber mat having an average fiber size of 4.3 $\mu$m, a filling density of 0.32 g/cm$^3$ and a thickness of 10 mm is used. The same measurement as in Example 1 is carried out with respect to this muffler. The results are shown in Table 1.

COMPARATIVE EXAMPLES 5–7

A muffler is prepared by repeating the same procedure as in Example 4 except that kind of the woven fabric as the scattering prevention member and the number of each of the wefts and warps per 25 mm$^2$ of the woven fabric are changed as shown in Table 2. The measurement of noise before the actual running is carried out in the same manner as in Example 1. The results are shown in Table 2 together with the result of Example 4.

COMPARATIVE EXAMPLES 8–10

A muffler is prepared by repeating the same procedure as in Example 5 except that kind and thickness of the metal foil are changed as shown in Table 3.

The measurement of noise before the actual running is carried out in the same manner as in Example 1.

The results are shown in Table 3 together with the result of Example 5.

TABLE 1

| | Exhaust noise value (dB) | Exhaust noise value after running (dB) | Weight reduction ratio (%) |
|---|---|---|---|
| Example 1 | 75.2 | 75.3 | 0 |
| Example 2 | 75.9 | 76.0 | 0 |

TABLE 1-continued

| | Exhaust noise value (dB) | Exhaust noise value after running (dB) | Weight reduction ratio (%) |
|---|---|---|---|
| Example 3 | 76.1 | 76.2 | 0 |
| Example 4 | 75.5 | 75.5 | 0 |
| Example 5 | 75.9 | 75.8 | 0 |
| Comparative Example 1 | 75.4 | 80.3 | 6 |
| Comparative Example 2 | 76.5 | 82.1 | 15 |
| Comparative Example 3 | 78.1 | 78.3 | 0 |
| Comparative Example 4 | 79.3 | 79.2 | 0 |

TABLE 2

| | | Per 25 mm$^2$ of woven fabric | | |
|---|---|---|---|---|
| | Kind of woven fabric | Number of warps | Number of wefts | Noise value (dB) |
| Example 4 | alumina fiber | 15 | 15 | 75.5 |
| Comparative Example 5 | silica fiber | 55 | 55 | 78.6 |
| Comparative Example 6 | ceramic fiber | 60 | 60 | 80.1 |
| Comparative Example 7 | alumina fiber | 60 | 60 | 79.6 |

TABLE 3

| | Metal foil | | |
|---|---|---|---|
| | Kind | Surface density (kg/m$^2$) | Noise value (dB) |
| Example 5 | SUS304 | 0.16 | 75.9 |
| Comparative Example 8 | aluminum | 0.32 | 78.5 |
| Comparative Example 9 | SUS304 | 0.40 | 80.3 |
| Comparative Example 10 | aluminum | 0.40 | 79.8 |

The peculiar action and effect of the muffler according to the invention are mentioned as follows.

(a) In the muffler according to the invention, the stainless woven wire cloth, inorganic fiber woven fabric or metal foil is used as the scattering prevention member instead of the stainless wool used in the conventional muffler, and the crystalline alumina fiber mat having excellent heat resistance and heat insulating property is wound thereon as a part of the sound absorbing material.

Therefore, thermal conduction to the glass fiber mat further wound as a part of the sound absorbing material is controlled and hence the degradation of the glass fiber mat due to heat of the exhaust gas is prevented. And also, the scattering of the sound absorbing material due to pulsation of the exhaust gas can be prevented by the scattering prevention member. Furthermore, since the content of granulated substance of not less than 44 $\mu$m is restricted to not more than 10 wt %, the movement of shot in the inside of the crystalline alumina fiber mat due to vibration is prevented.

(b) The crystalline alumina fiber mat is excellent in the sound absorptivity as compared with the stainless wool, so that the muffler can be compacted.

(c) In order to mitigate the thermal expansion difference produced between the metal tube and the metal shell, when the stainless woven wire cloth is used as the scattering prevention member instead of the stainless gasket used in the conventional muffler, an end of the stainless woven wire cloth is folded by at least one turn and disposed in the gap between the metal tube and the metal shell, whereby the buckling due to compression of the metal tube based on the thermal expansion difference, the peeling of weld portion and the like are prevented, and hence the step of previously welding the gasket to the metal shell as in the conventional technique is useless and the muffler can be assembled cheaply and easily.

Industrial Applicability

According to the invention, there can be provided a muffler for internal combustion engine, particularly automobile engine having excellent resistance to scattering even when being exposed to a high-temperature exhaust gas and capable of maintaining high sound absorption coefficient over a long period.

We claim:

1. A muffler for internal combustion engine comprising a metal tube provided with a plurality of small holes, an inorganic fiber sound absorbing material arranged on an outer periphery thereof and a metal shell covering an outside of the sound absorbing material, wherein a scattering prevention member is disposed between the metal tube and the sound absorbing material, and the sound absorbing material has a lamination structure comprising a crystalline alumina fiber mat containing not more than 10 wt % of granulated substance of not less than 44 $\mu$m and having an average fiber size of 3.5–10 $\mu$m is arranged on an outer periphery of the scattering prevention member at a filling density of 0.05–0.30 g/cm$^3$ and a glass fiber mat is laminated on an outer periphery of the crystalline alumina fiber mat at a filling density of 0.10–0.30 g/cm$^3$.

2. A muffler according to claim 1, wherein the scattering prevention member is selected from a stainless woven wire cloth, a woven fabric made from inorganic fiber and a metal foil.

3. A muffler according to claim 2, wherein the stainless woven wire cloth has a wire diameter of 0.1–1 mm and a net of 5–100 mesh.

4. A muffler according to claim 3, wherein an end of the stainless woven wire cloth is fixed to either the metal tube or the metal shell or both in the vicinity of either opening portion at both ends of the metal shell and the other end thereof is folded by at least one turn and interposed in a gap between the metal tube and the metal shell in the vicinity of the other opening portion of the metal shell.

5. A muffler according to claim 2, wherein the inorganic fiber woven fabric as the scattering prevention member is a woven fabric of inorganic fiber selected from ceramic fiber, alumina fiber and silica fiber having a filament diameter of 3–100 $\mu$m.

6. A muffler according to claim 2, wherein the metal foil as the scattering prevention member is a stainless or aluminum foil having a surface density of 0.05–0.27 kg/m$^2$.

* * * * *